United States Patent [19]

Decaux

[11] Patent Number: 4,797,959

[45] Date of Patent: Jan. 17, 1989

[54] SANITARY UNIT

[76] Inventor: Jean-Claude Decaux, 88, boulevard Maurice Barres, 92200 Neuilly, France

[21] Appl. No.: 37,558

[22] Filed: Apr. 13, 1987

[30] Foreign Application Priority Data

Apr. 17, 1986 [FR] France ..... 8605524

[51] Int. Cl.[4] ..... E03D 9/00; A47K 17/00

[52] U.S. Cl. ..... 4/662; 4/312; 4/DIG. 2

[58] Field of Search ..... 4/233, 662, 420, 307, 4/312, DIG. 2; 52/34, 65; 15/1.7

[56] References Cited

U.S. PATENT DOCUMENTS

| | | | |
|---|---|---|---|
| 2,166,944 | 7/1939 | Duner | 4/312 |
| 2,879,519 | 3/1959 | Mueller | 4/312 |
| 3,150,399 | 9/1964 | Dick et al. | 15/1.7 |
| 3,720,961 | 3/1973 | Garvey | 4/662 |
| 3,919,726 | 11/1975 | Godwin et al. | 4/DIG. 2 |
| 4,210,973 | 7/1980 | Decaux | 4/662 |
| 4,301,558 | 11/1981 | Decaux | 4/662 |
| 4,546,502 | 10/1985 | Lew | 4/420 |
| 4,561,132 | 12/1985 | Lew et al. | 4/420 |
| 4,597,114 | 7/1986 | Paterlini | 4/662 |

FOREIGN PATENT DOCUMENTS 0199682 10/1986 European Pat. Off. ..... 4/662

OTHER PUBLICATIONS

Automatic Public Toilet—Undated Publication.

*Primary Examiner*—Stephen Marcus

*Attorney, Agent, or Firm*—Andrus, Sceales, Starke & Sawall

[57] ABSTRACT

The invention relates to a sanitary unit having an automatic cleansing cycle. The unit comprises a lockable enclosure in which a partition defines a usage zone and a maintenance zone. A bowl is mounted for rotation between a utilization position in which it projects horizontally from the partition in said usage zone and a cleaning position in which it is tipped up into an opening in the partition so as to empty it into the maintenance zone. The upwards opening of the bowl is separated into two sections by a partition wall which extends upwardly to cooperate with the front walls of the bowl to form a rim surrounding the utilization section of the bowl. The bottom of the partition wall stops short of the base of the bowl to define an orifice and the rear section of the bowl forms an evacuation passage from the evacuation orifice rearwards to the maintenance zone when the bowl is tipped up.

13 Claims, 7 Drawing Sheets

FIG.1
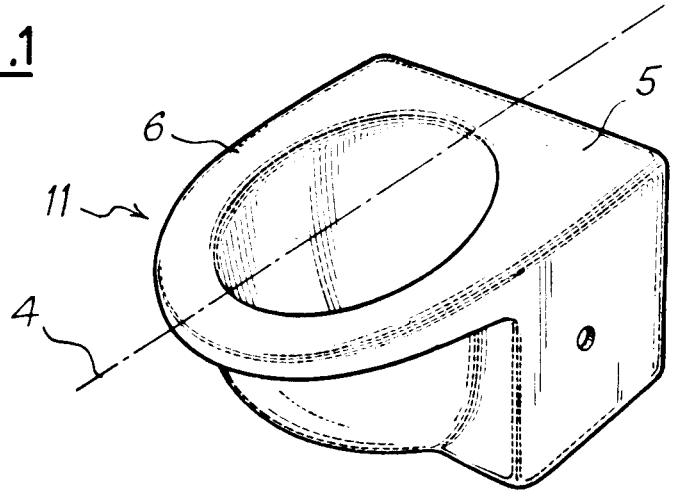
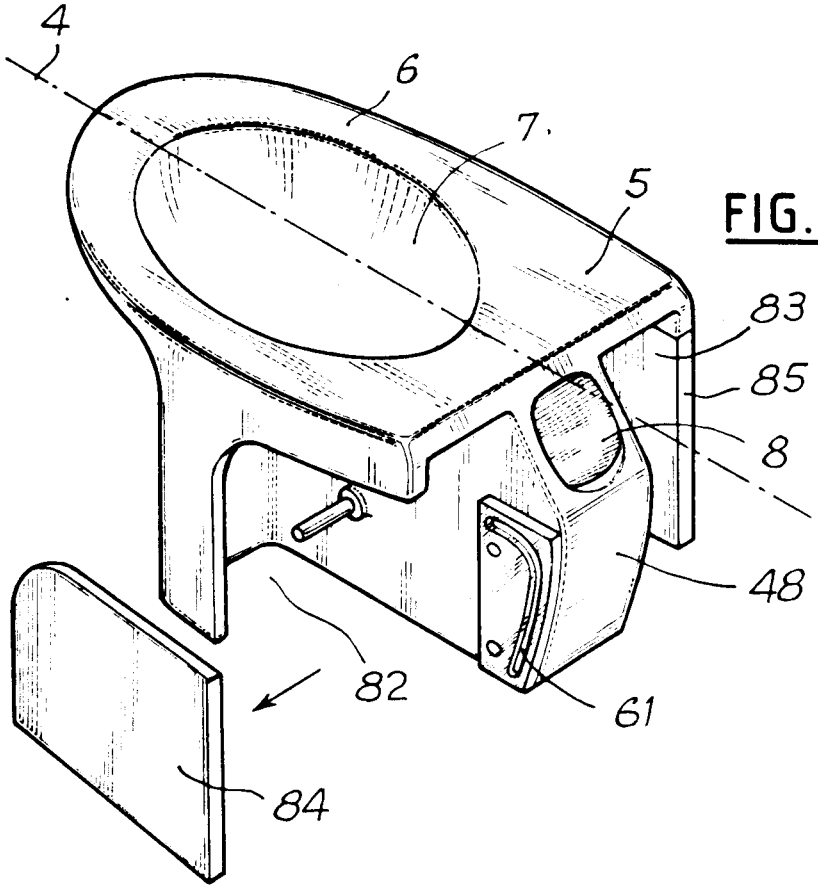
FIG.2

FIG. 3
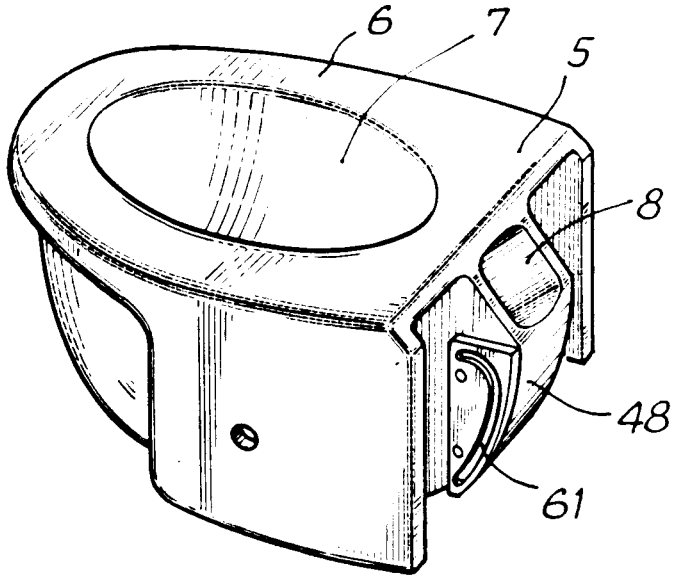
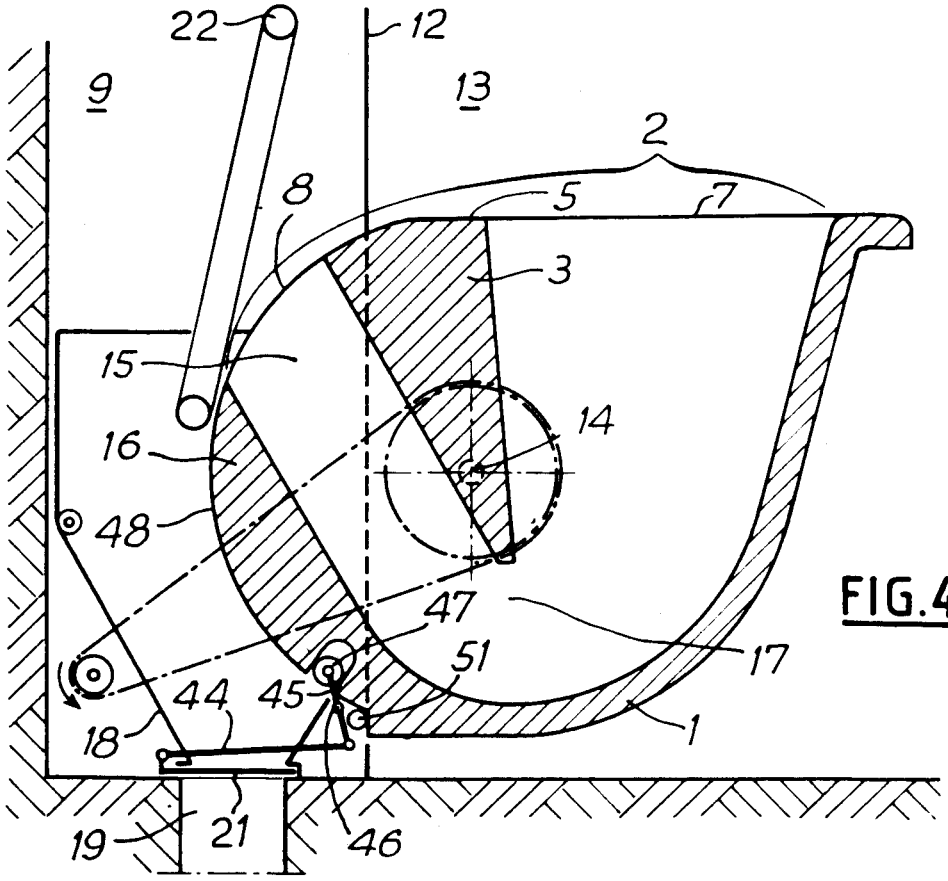
FIG. 4

54
9
79
53
13
78
59
58
26
24
52
25
29
27
77
3
65
14
57
76
64
62
55
56
19

FIG. 8
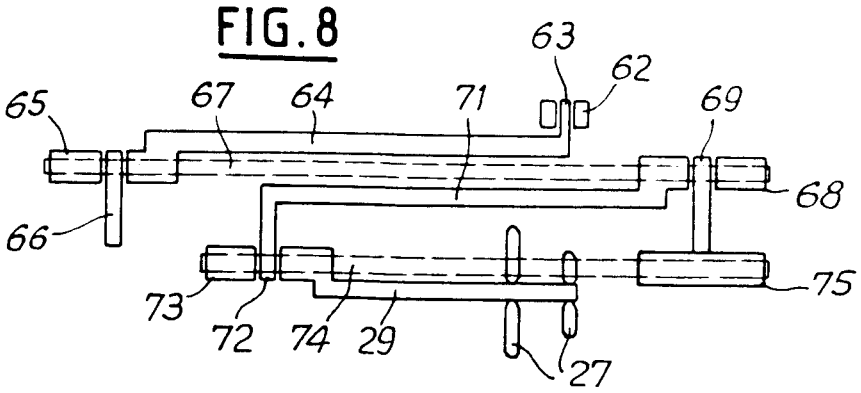
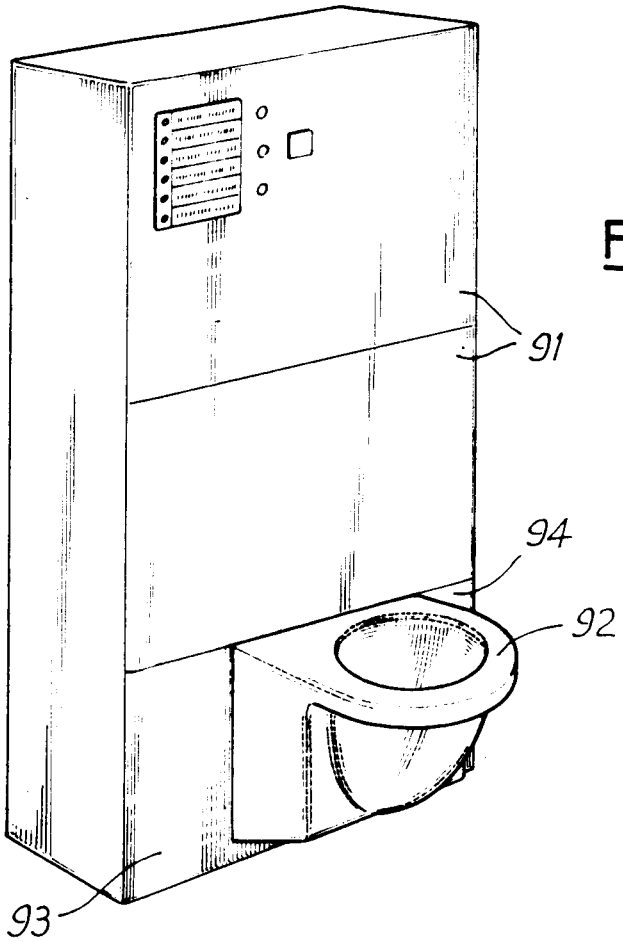
FIG. 9

SANITARY UNIT

BACKGROUND OF THE INVENTION

This invention relates to a sanitary unit and particularly to a sanitary unit having an automatic cleaning cycle. Such a unit may be installed in a public or semi-public situation and the cleaning cycle may be performed automatically when the user leaves the unit. The usage of the unit may be charged and the unit may form an autonomous construction which may be installed even in an unprotected location, such as a roadside pavement or public place. The unit may comprise a lockable enclosure comprising a partition defining two zones: a usage zone into which the user penetrates and whose access may be controlled by a coin-operated door and a maintenance zone which is inaccessible to the user.

A bowl or pan is disposed in juxtaposition to the partition and is mounted fo rotation about a horizontal axis parallel to the partition so as to pivot between a utilization position in which the bowl is substantially horizontal against the partition and a cleaning position in which the bowl is tipped vertically in an opening in the partition so as to be directed towards the maintenance zone, which contains the cleaning devices.

DESCRIPTION OF THE PRIOR ART

In a prior sanitary unit such as shown in U.S. Pat. No. 4,210,993, the bowl presents no orifice for evacuating deposits and the bowl is emptied into a chute and cleaned when it is tipped to its cleaning position, the contents flowing over the rear edge of the seat.

It is apparent that there is a certain reluctance by users to utilize this known sanitary unit for a certain number of reasons. Firstly, the bowl presents an unaccustomed appearance which is different from a conventional lavatory in which the bowl comprises either a drain with a syphon, or a drain orifice in the bottom covered by a retractable flap.

These automatically cleaning sanitary units are generally intended for the public to use and it is apparent that users lack confidence in the cleaning performed after each utilization, given that the cleaning is performed automatically after the user has left the enclosure. The reluctance comes in particular from the fact that the user does not himself trigger the cleaning and he does not see how the cleaning is performed.

Another problem arises from the fact that the rear upper rim of the bowl forms both a lip over which spill the contents of the bowl and the rear part of the seat; it follows that the rearrim must be carefully cleaned, which is indeed the case, but, given the fact that the user is unaware how the cleaning is performed, this further increases his mistrust. This reluctance generally causes users of such public sanitary units to use them like a seatless lavatory ("à la turque") even though they are in fact seated lavatories ("à l'anglaise"), the user wishing to avoid all contact with the bowl.

The cleaning operations are preceded by a tipping movement of the bowl which represents a danger for a person who might unfortunately be present in the enclosure during the cleaning operation; for this reason, complex safety devices are provided which detect the presence of a person in the usage zone. These safety devices are costly and moreover it is difficult to prevent all risks of accidents. Consequently, it is desirable to provide a cleaning system whose operation does not itself represent a danger.

OBJECTS OF THE INVENTION

An object of the present invention is to avoid some or all of the above disadvantages.

A more specific object of the invention is to avoid the contents of the bowl having to pour over the seat.

Another object of the invention is to provide an evacuation orifice in the bowl.

Yet another object of the invention is to provide improved cleansing means for the bowl.

Yet another object of the invention is to provide a higher degree of safety for displacement of the cleansing means.

Still another object of the invention is to enable the automatic cleansing operation to be triggered by a user.

BRIEF DESCRIPTION OF THE INVENTION

The present invention provides a sanitary unit comprising an enclosure, partition means for separating said enclosure into a usage zone accessible to a user and a normally inaccessible maintenance zone, a bowl juxtaposed with said partition means and mounted for pivoting between a utilization position in which said bowl projects generally horizontally from said partition means in said usage zone and a cleansing position in which said bowl is tipped towards an opening in said partition means, cleansing means disposed in said maintenance zone for cleaning said bowl in said cleansing position, and displacement means for displacing said bowl between said utilization and cleansing positions, wherein said bowl presents a closed base, a side wall defining an opening which is above said base in said utilization position of said bowl and a partition wall extending generally upwards when said bowl is in said utilization position and dividing said opening into a front utilization section and a rear evacuation section, said partition wall cooperating with said side wall to define a rim surrounding said utilization section of said opening and cooperating with a rear part of said side wall and with said base to define an orifice between said base and said partition wall and a passage between said orifice and said evacuation section of said opening, said evacuation section being higher than said orifice in said utilization position, whereby to contain the contents of the bowl, and being lower than said orifice in said cleansing position, whereby to empty the bowl into said maintenance zone.

In this way, without making an outlet in the base of the bowl, the contents of the bowl may be emptied through the evacuation section without pouring over the rim round the utilization section, and which may serve as a seat. Moreover, the partition wall and evacuation orifice in the bowl give an appearance resembling that of a drain hole and syphon in a conventional toilet.

In an embodiment of the present invention, said cleansing means comprises nozzle means disposed in said maintenance zone for facing said bowl in said cleansing position and fluid supply means for supplying liquid to said nozzle means to spray and wash said bowl and for passing air through said nozzle means whereby to dry said bowl. Preferably, said cleansing means includes at least one cleansing member and displacement means for displacing said cleansing member between a retracted rest position, and an operating position in which it projects into said utilization section of said opening when said bowl is in said cleansing position.

The cleansing member may comprise blades presenting nozzles rotated by the pressure of liquid sprayed out of the nozzles. This enables the cleaning of the bowl and seat to be improved, and particularly the drying of the seat and the cleansing of the utilization section visible to the user.

In a preferred embodiment of the invention, each said displacement means comprises a common motor and torque limiting means for limiting the torque transmitted by said displacement means. Accordingly, the risk of damage is reduced since the force applied in case of an accident by any of the moving parts is limited.

Advantageously, the unit includes control means for controlling said displacement means and said cleansing means in a cleansing cycle of operations, said control means being actuable from with said utilization zone. Preferably, said control means includes indicator means for indicating the operation of said cycle. In this way, apprehension of the user as to the effectiveness of the cleansing operation may be reduced since the operations may be triggered before him and the sequence of operations may be followed by the indicator. It will be appreciated that the triggering of the cleansing cycle from within the unit is only acceptable if the level of safety is high, for example if the unit includes a torque limiter as mentioned above.

DESCRIPTION OF THE DRAWINGS

Other features and advantages of the invention will appear from the following description, given by way of example, with reference to the accompanying drawings, in which:

FIG. 1 is a rear perspective view of a bowl for a sanitary unit in accordance with an embodiment of the present invention, FIG. 2 is a rear perspective view in more detail of a first embodiment of the bowl of FIG. 1, FIG. 3 is a rear perspective view in detail of a second embodiment of the bowl of FIG. 1, FIGS. 4 to 7 are sectional views along the longitudinal axis of the bowl showing the sanitary unit in accordance with this embodiment of the invention and showing, in particular, the various parts of a drive train for driving the movable parts, FIG. 8 is an exemplary diagram showing part of said drive train, and FIGS. 9 and 10 are schematic perspective views showing part of the sanitary unit.

DESCRIPTION OF PREFERRED EMBODIMENTS OF THE INVENTION

Figure 5:
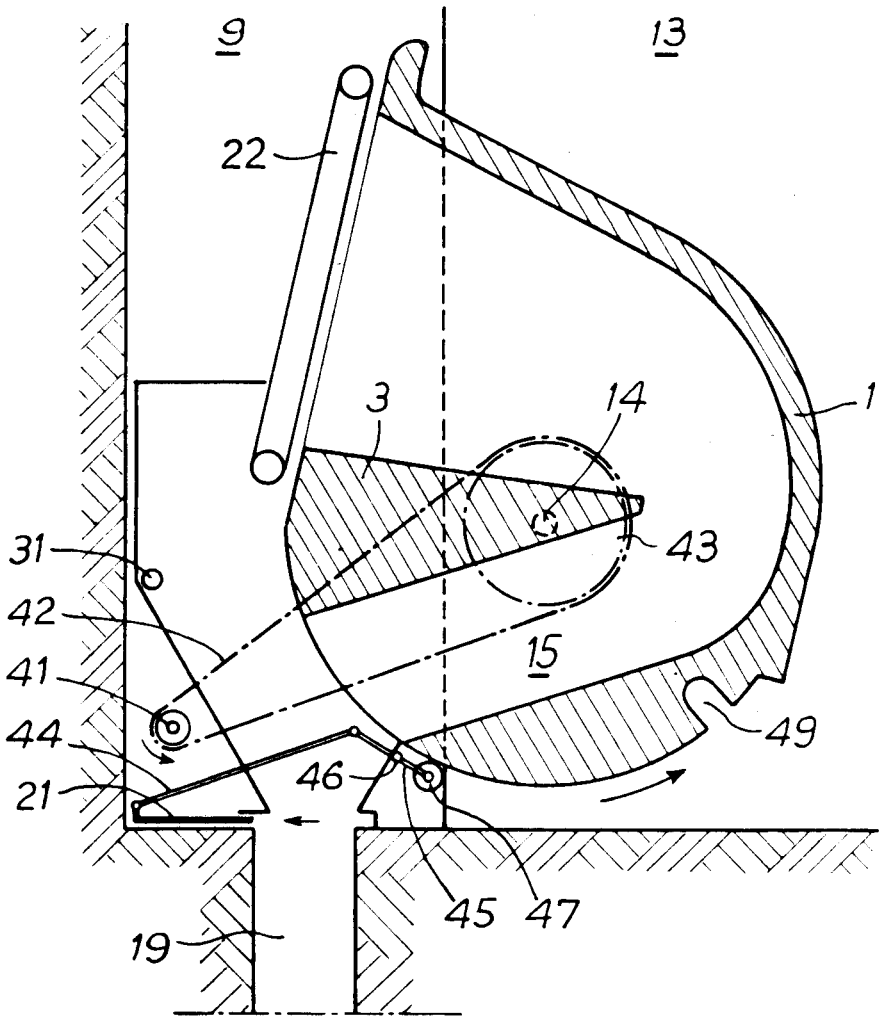

FIGS. 1 to 3 show an important element in the invention, namely the bowl, which is also shown in section in FIGS. 4 to 7. It will be noticed in particular that, as shown in the drawings, the bottom of the bowl 1 does not present any drain orifice; in fact its upper opening 2 is divided into two parts by a separating wall 3, which is perpendicular to the axis of symmetry 4 of the bowl; this separating wall extends from the level of the opening 2 towards the bottom 1 of the bowl and stops above the bottom. The upper face 5 of the wall 3 forms the rear part of the rim 6 of the bowl on which the user sits, since the sanitary unit is a seated "English-style" water closet.

Figure 6:
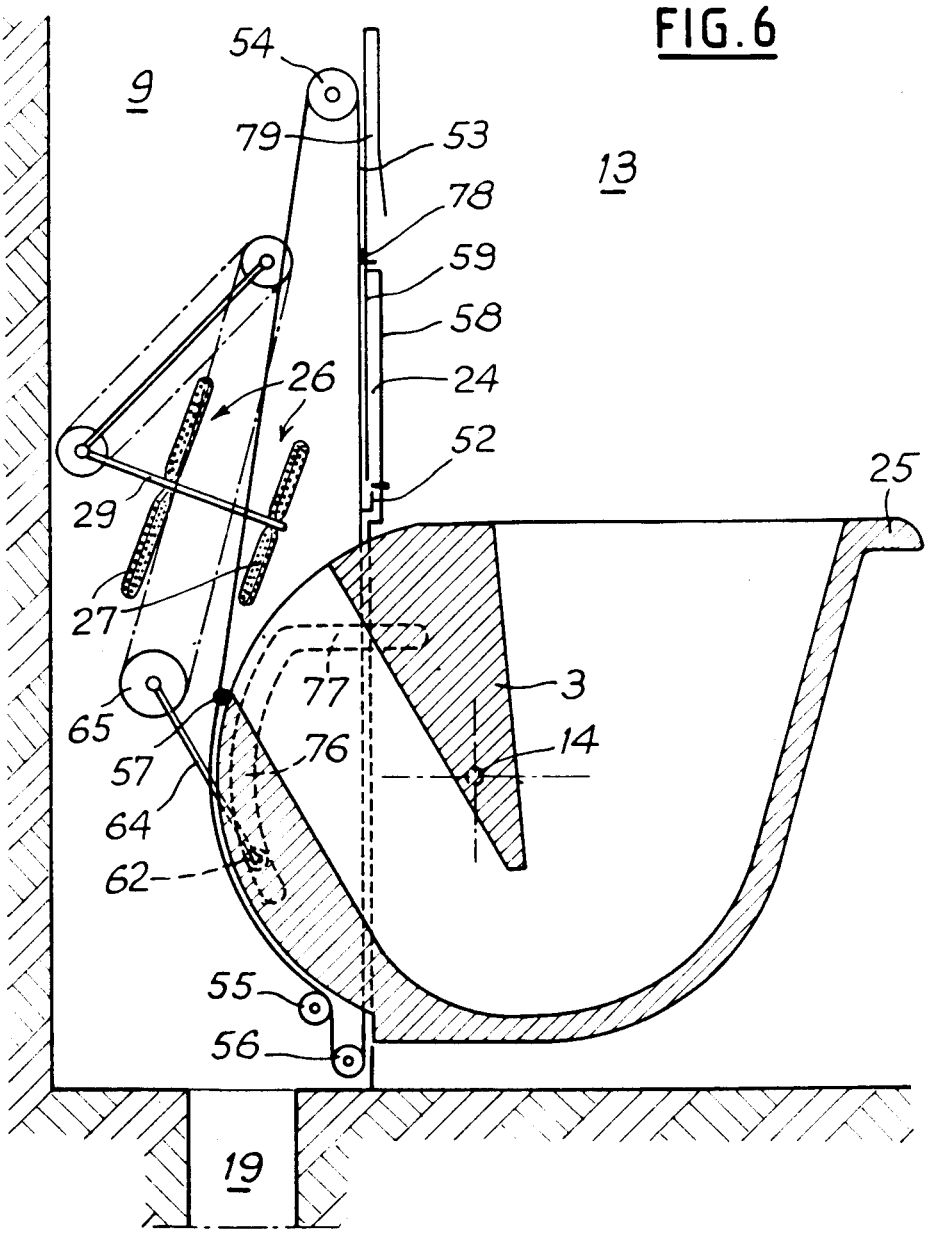

As shown more particularly in FIGS. 2 to 7, the separating wall 3 defines two sections of the upper opening 2 of the bowl, namely a utilization section 7 which is the only section visible to the user and an evacuation section 8 which, as shown in FIGS. 4 to 6, opens into the maintenance zone 9 of the sanitary unit when the bowl is in the horizontal usage position and is therefore not visible to users.

As shown in FIGS. 4 to 7, the bowl 11 is disposed in a locked enclosure to which access is controlled by a coin-operated lock; this enclosure is divided in two by a partition 12 so as to define a usage zone 13 which is the only zone accessible to the user and a maintenance zone 9 which includes in particular all the cleaning members and their mechanical drive. The bowl 11 is juxtaposed with the partition 12, its axis of symmetry 4 being perpendicular to the partition, and, as indicated above, only the utilization section 7 is disposed in the usage zone 13 while the bowl extends horizontally in its utilization position; the rear part of the bowl 11, including the evacuation section 8 extends through an opening in the partition 12 and projects into the maintenance zone 9.

The bowl 11 is movable rotatably about a horizontal axis of rotation 14 which is parallel to the partition 12. In a first position, the utilization position, which is shown in FIGS. 4 and 6, the bowl is disposed horizontally, that is to say the seat 6 is horizontal and the duct 15, which is formed between the rear part 16 of the bowl and the wall 3 to connect the evacuation section 8 to the gap 17 under the wall 3, gives the user the impression of a syphon, as in a conventional water closet.

Figure 7:
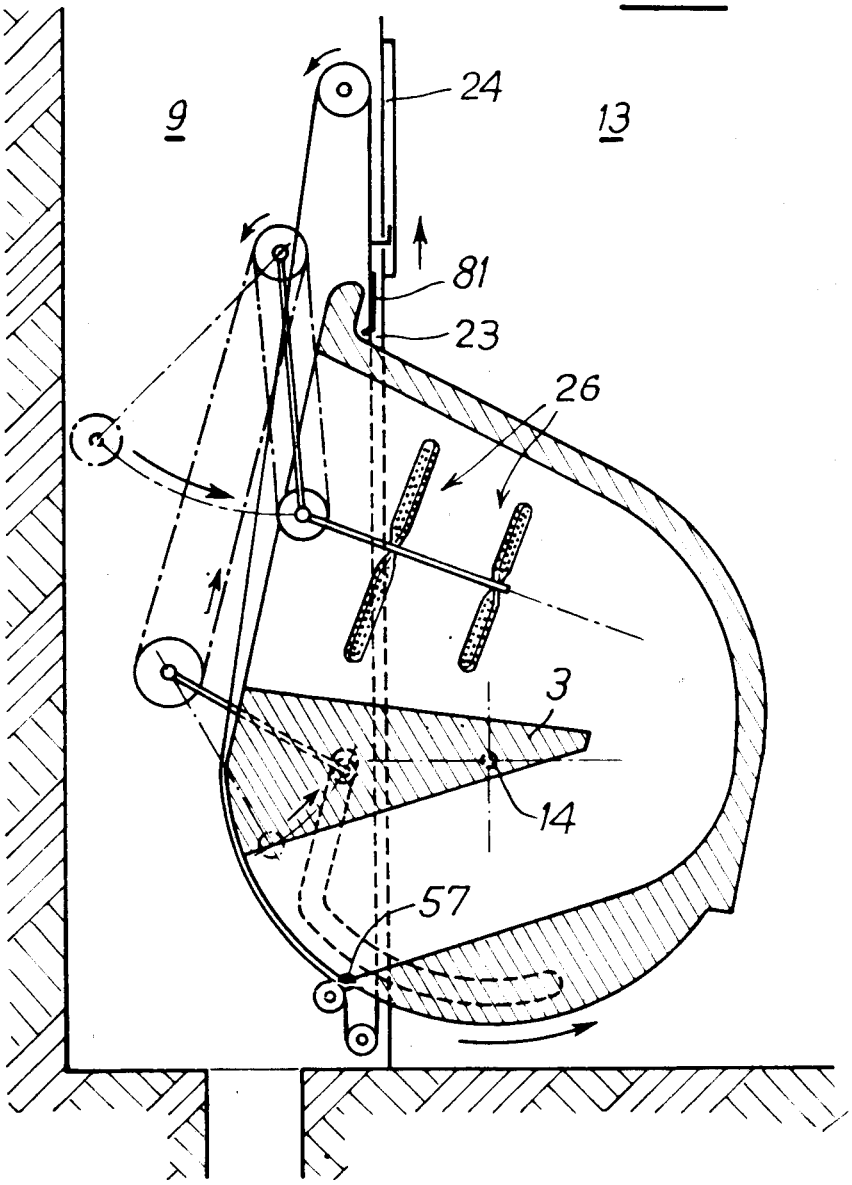

The bowl 11 can pivot through a quarter of a turn about the axis 14 to reach its cleaning position as shown in FIGS. 5 and 7; in this position, the evacuation section 8 communicates with a funnel-shaped evacuation shoot 18 which opens into a duct 19, for example a used water drain. Consequently, in this position, the contents of the bowl 11 are evacuated into the drain 19.

Given that there is no syphon, a shutter 21 is provided which closes off communication between the drain 19 and the chute 18 while the bowl is disposed in its utilization position (FIGS. 4 and 6) so as to avoid propagation of odours coming from the drain 19. A mechanism, described below, opens the shutter 21 when the bowl is in the cleaning position shown in FIGS. 5 and 7.

In the maintenance zone 9, a washing and drying nozzle 22 of substantially circular ring shape is provided, its shape matching that of the seat 6. The cleaning ring 22 is disposed in the maintenance zone in such a way that it is juxtaposed with the seat 6 when the bowl 11 is disposed in its cleaning position. The cleaning ring 22 is provided with spray nozzles which are designed to spray cleaning and disinfectant liquids onto the seat 6. The ring 22 also includes apparatus for drying the seat, the dryer using the same nozzles as the cleaner. In a variant embodiment, drying may be obtained- by suction instead of blowing air.

As shown in FIGS. 6 and 7, the partition 12 comprises an opening 23 which is disposed above the bowl when the bowl in its utilization position; this opening 23 offers a passage to the front part 25 of the bowl when it is tipped up to the cleaning position, and is otherwise normally closed by a shutter 24 which is retracted during tipping of the bowl. In the example illustrated, the shutter slides vertically along the partition 12 to a retracted position shown in FIG. 7; this sliding movement is driven by a mechanism described below.

As shown in FIGS. 6 and 7, a cleaning apparatus 26 is disposed in the maintenance zone 9 for operation when the bowl is in its utilization position and projects through the spray ring 22 to penetrate into the utilization section 7 of the bowl when the bowl is in its cleaning position. The cleaner 26 advantageously comprises two blades 27 and 28 mounted for rotation on a support arm 29 and provided with spray nozzles. Blades of this type are used for example, in dish-washers and their rotation is driven by the pressure of water sprayed out of the cleaner nozzles. The mechanism for displacing the arm 29 is described below.

As shown in FIGS. 4 and 5 a spray wash 31 advantageously extends along the inner wall of the chute 18 and is designed to clean the chute.

The operation of the various apparatuses described above is illustrated schematically by the two sequences FIGS. 4 and 5 and FIGS. 6 and 7, for the sake of clarity. When the bowl 11 is disposed in its utilization position, the shutter 21 closes communication between the chute 18 and the drain 19, the shutter 24 is in its closure position (FIG. 6) and the cleaner is retracted in the maintenance zone 9 (FIG. 6). When the bowl tips up towards the cleaning position, the shutter 24 slides upwards, the shutter 21 opens, and the cleaner 26 penetrates into the utilization section 7 of the bowl 11. The sprays 22 and 31 are actuated as well as the cleaner 26; a cleaning action is thus obtained in the utilization section 7 on the seat 6 and the funnel-shaped shoot 18. The ring 22 then performs a drying operation for the seat 6 and when that is terminated, the bowl returns to the utilization position.

A user may then enter the enclosure of the sanitary unit and will find a perfectly clean and dry seat and a clean utilization section, which is the only section visible to him.

The drive mechanisms for the various movable members described above will now be described with reference to FIGS. 4 to 8. In accordance with this embodiment of the invention, all the mechanically driven movable members are driven from a single motor, for example an electric motor, which acts on a transmission comprising drives for the various movable members. To avoid the movement of the members being a danger for a user who might be within range during the cleaning phase, a torque limiter is disposed on the driving side of the transmission so that if an abnormally big force is developed during one of the movements programmed in the cleaning cycle, the transmission halts. By regulating the threshold torque of the limiter, the application of any dangerous force by the various moving members of the unit to a user in range thereof is avoided.

Advantageously, safety devices may also be provided to detect abnormal movements of the shutter 24 and to halt the drive motor; for example, a micro-switch may be positioned behind the shutter 24 to detect a thrust movement thereon, and a similar detector may be disposed in the path of the shutter 24 sliding down to detect introduction of an object into the opening 23 during the cleaning cycle.

Advantageously, the motor drives the bowl 11 in rotation, and all the other mechanical drives are derived from movement of the bowl; in this case, the torque limiter is disposed directly on the motor shaft.

Referring to FIGS. 4 and 5, a fixed pulley wheel 41 is driven directly by the motor through the torque limiter; this pulley drives a further pulley 43 through a belt 42, the pulley 43 being solid with the bowl 11 and mounted on its rotation shaft 14. As shown in FIG. 5, rotation of the pulley 41 anti-clockwise cases the bowl to tip from its utilization position to its washing position.

The drive for actuating the shutter 21 is shown in FIGS. 4 and 5. The shutter 21 is slidable horizontally and is actuated by a linkage system including two rods 44 and 45, the rod 45 pivotting about a fixed axis 46. The free end of the push rod 44 is hinged to the shutter 21 and the free end of the pivotting rod 45 bears a loose roller 47. Also, the rear face of the bowl 11 comprises a cylindrical part 48 whose axis is at the axis of rotation 14 of the bowl and which serves as a rolling track for the roller 47. A reces 49 is formed in the cylindrical part 48 to receive the roller 47 when the bowl 11 is in its utilization position. The whole shutter drive system is subjected to a return force which tends to rotate the rod 45 anti-clockwise, that is to say so as to return the shutter 21 to its closed position. During rotation of the bowl and in particular of its cylindrical part 48, the roller 47 is first displaced by the recess 49 and then rises out of the recess to roll on the cylindrical track 48 once the shutter is completely open. During the return movement of the bowl 11 towards its utilization position, the roller rolls first on the track 48 and then penetrates into the recess 49, closing the shutter 21 under the effect of the return device to revert to the position shown in FIG. 4.

As explained above, the matter contained in the bowl 11 is poured into the chute 18 passing over the rear part of the bowl 11, that is to say the cylindrical part 48. The track 48 may consequently be dirtied and a wash spray 51 may be provided for actuation during the return movement of the bowl 11.

The drive mechanisms for the shutter 24 and the cleaner 26 are shown in FIGS. 6 and 7.

The shutter 24 is driven by a peg 52 which hooks into the shutter and is borne by a belt 53 which passes round an upper pulley 54 and two lower pulleys 55 and 56. The belt 53 is fixed at 57 to the top end of the cylindrical track 48. The pulley 55 is an angle-changing pulley disposed in such a way that a lower stretch of the belt 53 is wrapped round the cylindrical part 48.

As shown in the drawing, the shutter 24 has two walls, an outer wall 58 and an inner wall 59 which extends less far down than the outer wall 58. When the bowl is in its utilization position as shown in FIG. 6, the drive peg 52 is disposed at a certain distance from the inner wall 59 into which it hooks, so that the vertical sliding movement which opens the shutter is delayed. When the bowl 11 reaches its cleaning position, the shutter is in its open position, as shown in FIG. 7.

The displacement of the cleaning apparatus 26 is also driven through the movement of the bowl and, as shown in particular in FIGS. 2 and 3, a guide groove 61 is formed in the side wall of the rear part of the bowl for this purposes; the groove 61 guides a roller 62 which is mounted idly on a shaft 63 fixed to the end of an arm 64 whose other end is solid with a pulley 65. The pulley 65 is mounted for rotation about a fixed shaft 66, and drives a belt 67 which meshes also with a pulley 68 which rotates about a fixed axis 69 and is solid with one end of an arm 71. The other end of the arm 71 bears a shaft 72 on which is mounted idly a pulley 73 which is solid with the support arm 29 bearing the cleaner 26. The pulley 73 meshes with a belt 74 -which also meshes with a fixed pulley 75 solid with the shaft 69. The complete mechanism comprising these members is shown schematically in FIG. 8.

The operation of this drive mechanism is as follows. As shown in particular in FIGS. 6 and 7, the guide groove 61 comprises a part-circular section 76 centred on the axis of rotation 14 of the bowl extended by a straight section 77 which is substantially horizontal when the bowl is in its utilization position. During the rotational movement of the bowl, as long as the roller 62 runs in the circular section 76 of the groove 61, there is no movement of the mechanism; however, when the roller 62 passes into the straight section 77, the arm 64 is driven to rotate anticlockwise as seen in FIGS. 6 and 7, which causes the pulley 65 and thus the pulley 68 to rotate in the same direction, so that the arm 71 turns anticlockwise also to arrive in the position shown in FIG. 7.

The arm 29 supporting the cleaning blades 27 and 28 unfolds in the following way. As indicated above, during the rotational movement of the bowl 11 towards its cleaning position, the arm 71 turns anti-clockwise about the shaft 69; it takes the belt 74 with it during its rotational movement and, since the pulley 75 is fixed, the belt 74 rotates the pulley 73 clockwise, which also rotates the arm 29 clockwise about the shaft 72 and the arm 29 unfolds relative to the arm 71. As mentioned above, this movement is delayed by the inactive circular section in the guide groove 61.

Advantageously, the belt 53 may be provided with a stop 78 disposed just above the shutter 24 when the bowl is in its utilization position; this stop serves as a safety device preventing any manual actuation of the shutter when it is closed.

In accordance with this embodiment of the invention, it may be arranged so that a wash cycle may be triggered by a user from inside the sanitary unit; this cycle may be a normal cleaning cycle or a shorter cycle. This is possible since, as indicated above, the sanitary module is given a high degree of safety by the presence of the torque limiter. Advantageously, an indicator 79 may be provided, for example in the partition 12 above the bowl 11, to display indications concerning the operation and sequencing of the cleaning cycle. For example, the indicator may comprise coloured indications symbolizing the various phases (cleaning, disinfecting, drying, and so on).

The maintenance zone is small in dimension and it is not possible to gain access thereto from the outside of the sanitary unit enclosure; consequently, a hatch is formed in the partition 12 which may be opened to enable maintenance of the various mechanical elements of the unit.

Figure 10:
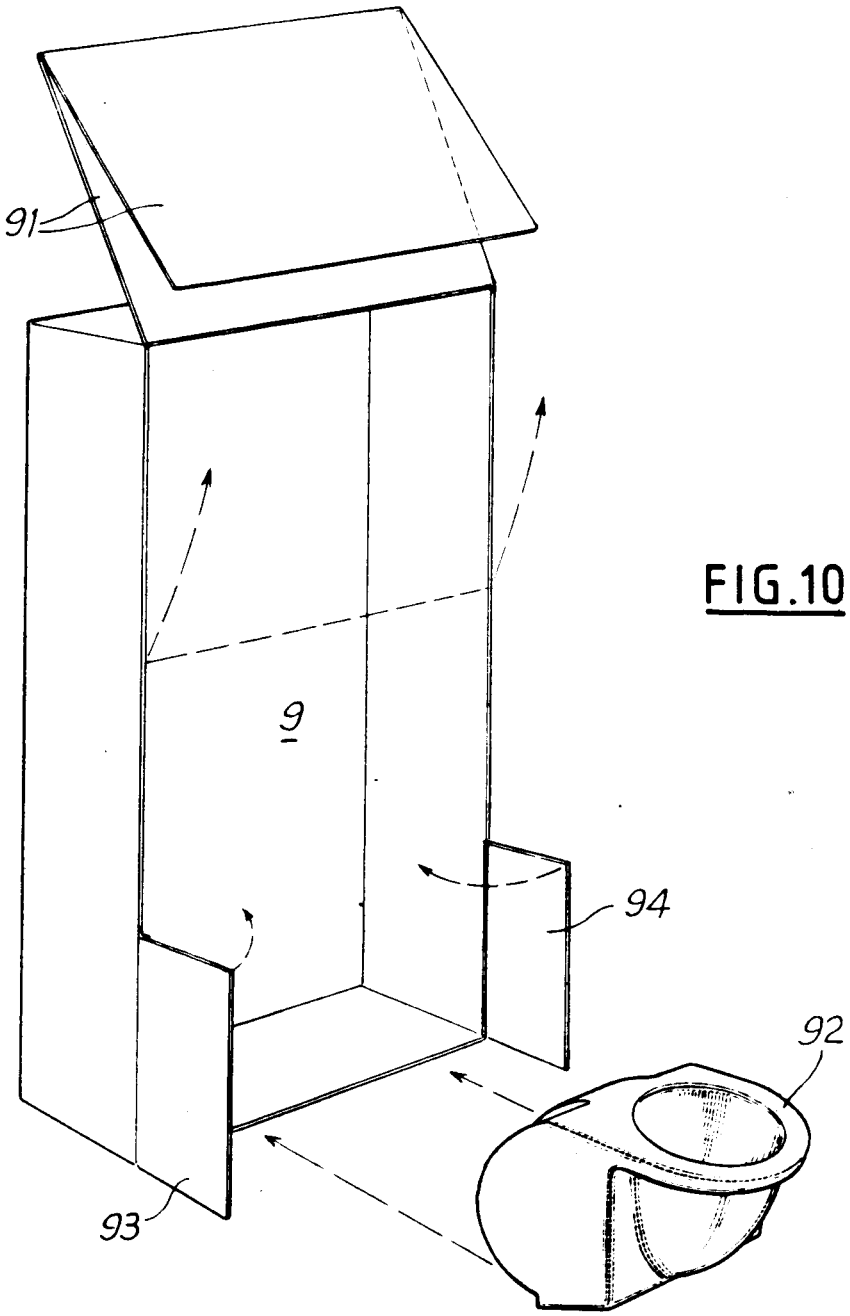

In a variant embodiment shown in FIGS. 9 and 10 a vertical hinged hatch 91 is provided which opens to give access to the maintenance zone 9, which is again of small dimensions, and access thereto also facilitated by the fact that the bowl 92 also forms a cover masking most of the drive mechanisms and the bowl 92 may be removed as shown in FIG. 10 to gain access to the drive mechanisms. It may also be arranged for the parts 93 and 94 of the partition wall disposed on each side of the bowl 11 to be mounted for opening as shown in FIG. 10 so as to offer access to the entire maintenance zone 9.

To simplify maintenance operations, it is advantageous to provide a centralized greasing system for the various mechanical members, supplied from a cartridge containing a grease and which is replaced regularly.

To avoid a risk of splashing liquid into the usage zone during the cleaning cycle, a flexible protection skirt 81 may be disposed around the edge of the opening formed in the partition 12 which is closed by the shutter 24 in the utilization position and whose shape matches the seat.

FIGS. 2 and 3 show two different embodiments for the rear part of the bowl 11; in the embodiment of FIG. 2, two recesses 82 and 83 are provided on either side of the cylindrical part 48 to receive the mechanism for rotational drive of the bowl and the recesses are closed by two removable side walls 84 and 85. In this embodiment, the drive mechanism for the bowl is therefore masked by the side walls 84 and 85. In the embodiment of FIG. 3, the drive mechanism for the bowl is disposed externally thereto.

It will be appreciated that these embodiments of the invention provide a sanitary unit in which the cleaning operations are performed with a high degree of security; moreover, the seat is well cleaned and dried so as to avoid the user being reluctant to use the seat normally. Also, the possibility of triggering the wash cycle by the user and the explanations given by the indicator help to overcome any possible remaining reluctance.

The sanitary unit is of small dimensions and is particularly suitable for protected public or semi-public situations such as station concourses, petrol stations, and so on. The dimensions of the unit are so small that it is even possible to consider its installation in a private dwelling.

I claim:

1. A sanitary unit comprising an enclosure, partition means for separating said enclosure into a front usage zone accessible to a user and a normally inaccessible rear maintenance zone, a bowl juxtaposed with said partition means and mounted for pivoting between a utilization position in which said bowl projects generally horizontally from said partition means into said usage zone and a cleansing position in which said bowl is pivoted rearwardly at least partially past said partition means, cleansing means disposed in said maintenance zone for cleaning said bowl in said cleansing position, and drive means for pivoting said bowl between said utilization and cleansing positions, said bowl having a closed base, an outer wall defining an opening which is above said base in said utilization position of said bowl and a separating wall extending generally vertically when said bowl is in said utilization position and dividing said opening into a front utilization section and a rear evacuation section, the upper face of said separating wall cooperating with said outer wall to define a rim surrounding said utilization section of said opening, and said separating wall cooperating with a rear part of said outer wall and with said base to define a passage between said utilization section and said evacuation section of said opening, said evacuation section being higher than said passage in said utilization position, whereby to contain the contents of the bowl, and being lower than said passage in said cleansing position, whereby to empty the contents of the bowl into said maintenance zone.

2. A sanitary unit as claimed in claim 1 wherein said cleansing means comprises nozzle means disposed in said maintenance zone for facing said bowl in said cleansing position and fluid supply means for supplying liquid to said nozzle means to spray and wash said bowl and for passing air through said nozzle means whereby to dry said bowl.

3. A sanitary unit as claimed in claim 1 wherein said cleansing means includes at least one cleansing member and drive means for moving said cleansing member between a retracted rest position, and an operating position in which it projects into said utilization section of said opening when said bowl is in said cleansing position.

4. A sanitary unit as claimed in claim 1 wherein said cleansing means includes drain means for receiving matter emptied from said bowl, closure means for closing said drain means, and drive means for moving said closure means between a closed position when said bowl is in said utilization position and an open position when said bowl is in said cleansing position.

5. A sanitary unit as claimed in claim 1 wherein said partition means includes shutter means and drive means for moving said shutter means between a closed position when said bowl is in said utilization position, and an open position in which it retracts to accommodate said bowl projecting through said partition means when said bowl is in said cleansing position.

6. A sanitary unit as claimed in claim 5 wherein said shutter means includes safety means responsive to abnormal forces for halting said drive means.

7. A sanitary unit as claimed in claim 3, 4 or 5 wherein each said drive means comprises a common motor and torque limiting means for limiting the torque transmitted by said drive means.

8. A sanitary unit as claimed in claim 1 wherein said partition means includes lockable closure means which may be opened to obtain access to said maintenance zone.

9. A sanitary unit as claimed in claim 2 wherein said fluid supply means is actuable to dry said bowl by suction.

10. A sanitary unit as claimed in claim 1 and including control means for controlling said drive means and said cleansing means in a cleansing cycle of operations.

11. A sanitary unit as claimed in claim 10 wherein said control means is responsive to a person leaving said enclosure to trigger said cleansing cycle.

12. A sanitary unit as claimed in claim 10 or 11 wherein said control means is manually actuable from within said utilization zone.

13. A sanitary unit as claimed in claim 10 wherein said control means includes indicator means for indicating the operation of said cycle.

* * * * *